US012366134B2

(12) United States Patent
Delgado

(10) Patent No.: US 12,366,134 B2
(45) Date of Patent: Jul. 22, 2025

(54) METHOD FOR PREPARING A WELLBORE

(71) Applicant: DSOLVE AS, Trondheim (NO)

(72) Inventor: Carlos J. Delgado, Trondheim (NO)

(73) Assignee: DSOLVE AS, Trondheim (NO)

( * ) Notice: Subject to any disclaimer, the term of this patent is extended or adjusted under 35 U.S.C. 154(b) by 35 days.

(21) Appl. No.: 17/927,690

(22) PCT Filed: May 26, 2021

(86) PCT No.: PCT/NO2021/050134
§ 371 (c)(1),
(2) Date: Nov. 23, 2022

(87) PCT Pub. No.: WO2021/242114
PCT Pub. Date: Dec. 2, 2021

(65) Prior Publication Data

US 2023/0220741 A1 Jul. 13, 2023

(30) Foreign Application Priority Data

May 27, 2020 (NO) ..... 20200624

(51) Int. Cl.

| | |
|---|---|
| ***E21B 33/138*** | (2006.01) |
| ***E21B 29/00*** | (2006.01) |
| ***E21B 29/02*** | (2006.01) |
| ***E21B 33/12*** | (2006.01) |
| ***E21B 33/134*** | (2006.01) |

(52) U.S. Cl.
CPC ..... *E21B 33/1204* (2013.01); *E21B 29/02* (2013.01); *E21B 33/1212* (2013.01); *E21B 33/134* (2013.01); *E21B 33/138* (2013.01)

(58) Field of Classification Search
CPC ..... E21B 29/00; E21B 29/02
See application file for complete search history.

(56) References Cited

U.S. PATENT DOCUMENTS 6,439,313 B1 * 8/2002 Thomeer ..... E21B 43/108 166/376
11,377,925 B2 * 7/2022 Mueller ..... E21B 29/002
(Continued)

FOREIGN PATENT DOCUMENTS

NO 342501 B1 * 6/2018 ..... B23H 3/04
WO WO 2018/063003 A2 4/2018
(Continued)

OTHER PUBLICATIONS

Thesis of Trine Knutsen, "A Novel Approach to Qualifying Bismuth as a Barrier Material," the University of Stavanger, 2019.
(Continued)

*Primary Examiner* — Tara Schimpf
*Assistant Examiner* — Ursula Lee Norris
(74) *Attorney, Agent, or Firm* — Hershkovitz & Associates, PLLC; Abe Hershkovitz

(57) ABSTRACT

There is provided a method for preparing a wellbore for insertion of a barrier, the method comprising: providing a section of tubing or formation within the wellbore having a modified internal surface that is shaped such that a region adjacent the modified internal surface can be filled with barrier material and the barrier material can solidify to interlock with and be anchored by the modified internal surface.

19 Claims, 7 Drawing Sheets

(56) References Cited

U.S. PATENT DOCUMENTS

| | | | | |
|---|---|---|---|---|
| 2003/0047323 | A1* | 3/2003 | Jackson | E21B 43/105 166/380 |
| 2005/0000697 | A1 | 1/2005 | Abercrombie Simpson et al. | |
| 2013/0081814 | A1* | 4/2013 | Gaudette | E21B 23/00 166/376 |
| 2016/0010423 | A1 | 1/2016 | Myhre et al. | |
| 2018/0258735 | A1* | 9/2018 | Shafer | E21B 33/134 |
| 2018/0298715 | A1 | 10/2018 | Shafer | |
| 2019/0128092 | A1 | 5/2019 | Mueller et al. | |
| 2019/0271209 | A1 | 9/2019 | Shafer | |
| 2020/0165894 | A1 | 5/2020 | Shafer | |
| 2020/0173251 | A1 | 6/2020 | Shafer | |
| 2021/0148190 | A1 | 5/2021 | Ramakrishnan et al. | |
| 2021/0155841 | A1 | 5/2021 | Ramakrishnan et al. | |
| 2021/0156222 | A1 | 5/2021 | Shafer | |
| 2021/0164322 | A1 | 6/2021 | Ramakrishnan et al. | |
| 2021/0246748 | A1 | 8/2021 | Delgado | |

FOREIGN PATENT DOCUMENTS

| | | | | |
|---|---|---|---|---|
| WO | WO-2019151870 | A1 * | 8/2019 | E21B 29/08 |
| WO | WO 2019/194844 | A1 | 10/2019 | |
| WO | WO 2020/165573 | A1 | 8/2020 | |

OTHER PUBLICATIONS

International Search Report in International Application No. PCT/NO2021/050134, mailed on Sep. 16, 2021.

Written Opinion of the International Searching Authority in International Application No. PCT/NO2021/050134, mailed on Sep. 16, 2021.

Norwegian Search Report in related Norwegian Application No. 20200624, dated Dec. 2, 2020.

Office Action in related Norwegian Application No. 20200624, dated Dec. 2, 2020.

* cited by examiner

METHOD FOR PREPARING A WELLBORE

The present invention relates to a method for preparing a wellbore for insertion of a barrier. In particular, the present invention relates to a method for preparing a wellbore for installation of a downhole barrier which results in improved sealing capabilities for the barrier and prevents said barrier from shifting position along a longitudinal axis of the wellbore after the installation process is complete.

Standards for well integrity in drilling and well operations require that in a case where a well is to be permanently abandoned, the barriers placed in the well to prevent leakage should extend across the full cross-section of the borehole. The purpose of the cross-sectional barrier is to guarantee the isolation of permeable formations, reservoirs and other sources of inflow.

This requirement is currently met by cutting and pulling the tubing and casing, followed by setting of a cement barrier. This operation can be problematic as the casing string may become stuck due to the settling of particles. Multiple cut and pull operations may be necessary to remove the casings. Traditionally, cutting and pulling of the casing is done using a rig. Performing this operation can be time consuming, expensive, and can produce considerable levels of $CO_2$ emissions, especially in subsea wells.

The Oil & Gas industry is therefore actively looking for new ways to reduce cost and $CO_2$ emissions by eliminating the need for a drilling rig when performing Plug and Abandonment (P&A) operations within wells.

Some of the methods that have been previously used involve the provision of barriers made from materials other than the conventionally used cement. These alternative materials may prove to have better sealing properties than cement, resulting in a reduction in the required length of the barriers. Reducing the length of the barrier will consequently simplify the preparation of the well for P&A, which will result in a reduction in the operational cost. This cost may be further reduced if the preparation for P&A is performed using rig-less technology to remove sections of metal tubing.

A barrier material that is currently being tested in the North Sea is based on Bismuth, which is a metal having a low melting point. Once melted it has a viscosity that is similar to water and it expands when it solidifies. The barrier is placed in the wellbore by melting the bismuth on top of a previously placed mechanical barrier. Once the bismuth cools down it solidifies and expands to form a mechanical seal with the metal tubing that remains within the well or with the formation itself.

Based on Aker BP's development work and experience (as published in a Thesis from Trine Knutsen entitled 'A Novel Approach to Qualifying Bismuth as a Barrier Material' from the University of Stavanger, 2019) 2 out of 3 potential failure modes for barriers formed from bismuth are leakage around the bulk material and shifts in barrier position. A set bismuth barrier will not be chemically bonded to the metal tubing or to the formation, which means that the sealing capacity and the resistance to axial movement relies on the radial expansion of the bismuth during cooling. Depending on the bismuth alloy used, this expansion is between 0.4 to 1.4%. Extensive testing has demonstrated that radial expansion of the bismuth occurs in preference to axial expansion, likely because the barrier tends to cool fastest at the top and the bottom. Although a faster expansion rate can improve sealing to an extent, where the barrier is to sit against a metal tubing (such as a well casing) rapid expansion of the bismuth can cause unwanted rupturing of the tubing.

These features result in a reduction in efficiency of plugging methods using bismuth. The sealing capacity and the barrier position are both largely dependent on the expansion of the bismuth which is itself effected by the concentration of the bismuth and the internal temperature gradient during the creation of the barrier.

US-A-2018/258735 describes a method for accessing the annular space in a wellbore as part of plug and abandonment operations. A laser or abrasive cutters are used to cut a helical coil out of the casing or tubing in the wellbore to create a helical shaped opening in the tubing. The plugging material is later squeezed out through said helical coil openings. The helical shape of the openings is important since cutting ring-shaped openings, for example, will result in collapse of the casing.

Additional prior art also describes methods for plug and abandonment of a wellbore involving the removal of sections of the well casing. US-A-2016/010423, for example, describes use of one or more explosive charges which are detonated so as to extend the diameter of one or more of pipe cases at locations along the longitudinal section to be plugged. This way it is sufficient simply to pump the inner casing with the fluidized plugging material along a longitudinal section in order to obtain a satisfactory sealing and plugging of the wellbore. In US-A-2019/128092, a method is described which comprises the deployment of a downhole tool configured to remove or to rupture and expand both an inner tubular and an exterior casing at a section of well to be plugged where bismuth alloy pellets can be melted onto a blocking device.

The invention provides a method which can result in the improved performance of barriers deployed downhole for sealing oil and gas wells, and particular during plug and abandonment operations.

According to a first aspect of the present invention, there is provided a method for preparing a wellbore for insertion of a barrier, the method comprising: providing a section of tubing or formation within the wellbore having a modified internal surface that is shaped such that a region adjacent the modified internal surface can be filled with barrier material and the barrier material can solidify to interlock with and be anchored by the modified internal surface.

The surface against which the barrier bears once installed is shaped to form anchoring points. If the internal surface is that of a section of tubing or casing, then the external diameter of the tubing or casing may not be changed by the modification to the internal surface. Tubing may refer to the metal casing within the wellbore or to any other substantially tube-shaped surface within the wellbore. The shape of the external surface of the tubing is also not changed by the process of modifying the internal surface. The barrier material, which may comprise bismuth and/or cement, or any other material which is able to solidify sufficiently to remain in place, fills indents in the modified surface which helps to prevent the barrier from shifting position, in particular in the longitudinal axial direction. If the barrier does shift position then any seal may be broken, which will allow leakage out of the well. There will be some movement of the barrier due to expansion and compression caused by pressure, however the modified surface will provide an anchoring function to help to prevent the whole barrier structure from moving up the well, and potentially also from moving downhole.

The wellbore may comprise a tubular section, either formed by tubing or as an area excavated out of the formation itself. The internal surface refers to the surface of this tubular or excavated region facing the central longitudinal axis of the wellbore. The region adjacent the modified surface may refer to a region that is radially adjacent the surface. The surfaces of the barrier and tubing or formation interlock at an interface between the two in the sense that the shapes of the two surfaces will correspond to some extent. The barrier material will fill an indent or indents in the internal surface to form a corresponding protrusion or corresponding protrusions on the surface of the barrier. These one or more protrusions, which may each sit deeper in the wellbore than a wider portion of the internal surface, will help to anchor the barrier structure within the well. Anchoring longitudinally refers to the fact that the interlocking surfaces help to prevent the barrier from shifting position with respect to the tubing or formation, in particular along the direction of the longitudinal axis of the wellbore.

In embodiments, the internal surface is modified such that it is shaped with a pattern of indents.

In embodiments, the method comprises filling the region adjacent the modified internal surface with the barrier material and allowing the barrier material to solidify such that it interlocks with and is anchored by the modified surface.

In embodiments, the modified internal surface comprises a region of the surface having a radial cross section which varies longitudinally, such that the barrier material can be or is anchored longitudinally. The terms radial and longitudinal, as well as the terms up and down, are used herein in relation to the wellbore itself, or of the tubular area excavated from the formation or the tubular casing within the well. The central axis of the wellbore extends in the longitudinal direction and a direction towards the surface of the earth from inside the wellbore is an upwards direction. In embodiments where the internal surface is the surface of a section of tubing or casing, the internal diameter of the tubing may vary longitudinally along the modified surface where the external diameter of the tubing remains constant.

In embodiments, providing the modified section of tubing comprises modifying the shape of the internal surface of the downhole tubing or formation. The surface may be modified in-situ once it has been decided to close up a wellbore in a P&A operation. The modified surface may be an internal surface of a section of casing or tubing which has previously provided a different function, such as the transport of materials, isolation of formations or preventing the formation from caving, within the working well.

In embodiments, modifying the shape of the internal surface of the downhole tubing or formation comprises removing material from the metal tubing or formation using a downhole tool.

In embodiments, the internal surface is the internal surface of a section of electrically conductive tubing and modifying the shape of the internal surface comprises establishing an electrical connection between the internal surface of the electrically conductive tubing and at least one conductive element such that the selected portions of the internal surface are corroded via an electrolytic process.

In embodiments, a surface of the at least one conductive element is shaped with patterns or grooves to control the eventual shape of the modified internal surface of the metal tubing. As explained below, where the conductive element sits closer to the internal surface material will be corroded faster. This means that the shape of the corroded surface will mirror the shape of the electroconductive elements. The conductive element or elements may include radial grooves or a helical groove, or may be cone shaped or include a number of portions having different diameter.

In embodiments, the at least one conductive element is centrally placed in the tool. Centrally placed refers to the fact that the conductive elements are generally radially centrally located on the tool, and therefore are radially centrally located within the tubing or casing to be corroded (in the case where the internal surface is the surface of casing or tubing). If a number of conductive elements are used which are not tubular in shape, these may be centrally located in the tubing in that elements are equidistant from the longitudinal axis of the casing and of the tool. This allows for even corrosion in a radial direction around the internal surface of the casing, which is generally desirable. Corrosion in the longitudinal direction will not be uniform. This is in order to provide the indented parts of the internal surface.

In embodiments, modifying the shape of the internal surface of the downhole tubing or formation comprises adding material to the metal tubing or formation using a downhole tool. The shape of the surface can be modified in a number of ways, however removal of material from the surface is preferred since it does not necessitate the transport of additional materials into the well.

In embodiments, the modified surface is the internal surface of tubing or casing within the wellbore and for at least a portion of the modified section of tubing the internal diameter of the tubing varies in a direction parallel to the central axis of the tubing while the external diameter or the tubing remains constant. The surface includes the desired anchor point or points.

In embodiments, the modified internal surface comprises a plurality of radial grooves formed in the surface (grooves extending radially along the surface). Where the surface is the internal surface of a tube, and where the grooves extend all of the way around the surface, these will form rings. The grooves may be orientated in a direction perpendicular to the longitudinal axis of the wellbore. In embodiments, the profile of the grooves in a longitudinal cross section through the surface is sinusoidal. The profile is that shown in FIG. 1, i.e. a profile of the surface in a cross section taken through a longitudinal axis of the tube or of the wellbore. A helical groove can also be provided which will loop around the conductive element or elements in a spiral.

In embodiments, the profile of the groove or grooves in a longitudinal cross section through the surface is sinusoidal. Forces on the internal surface once the barrier is installed, and due to pressure from below the barrier, will be distributed along the upper portion of each of the one or more sinusoidal grooves. This will help to prevent damage to the casing. The internal surface resulting from the modification may have a stepped diameter going from a smaller diameter section at an upper end to a larger diameter section at a lower end.

In embodiments, the modified internal surface may be frustoconical in shape, and may represent the internal surface of a section of metal casing. This means that once the barrier material solidifies or solidifies and expands to fill the volume adjacent the internal surface, any pressure from below the barrier will transfer across a large surface area distributing forces on the internal surface and reducing the likelihood of rupturing of or damage to the casing.

In embodiments, the internal surface is the surface of a section of tubing and forming the modified surface comprises removing between 0.01% and 90%, preferably between 0.1% and 60%, and most preferably between 0.1% and 10% of the material in a length of the tubing. The percentage given refers to a percentage of the material in the section of the tube for which the surface is modified.

Regions of the tube for which the surface remains unmodified (which will usually mean regions for which the radial cross sectional shape of the surface does not vary longitudinally) are not included in the percentage calculation. It is preferable to remove as little material as possible in order to both provide adequate anchoring and sealing functionality and to maintain the integrity of the tubing. The above preferred ranges achieve this goal. It should be noted that the external surface shape may be modified due to natural processes such as corrosion, but will not be modified as part of the process undertaken to provide the modified internal surface.

In embodiments, the modified surface is the internal surface of tubing within the wellbore and for at least a portion of the modified section of tubing the internal diameter of the tubing varies in a direction parallel to the central axis of the tubing while the external diameter or the tubing remains unmodified.

In embodiments, the modified internal surface comprises a length of the tubing or formation internal surface which has a larger diameter at a lower end and a smaller diameter at an upper end.

In embodiments, the method comprises placing a plug in the wellbore below the level of the modified surface prior to filling the region adjacent the modified surface with the barrier material. This ensures that the barrier material remains in place prior to solidifying.

In embodiments, the method comprises filling a region of the wellbore such that once the barrier material has solidified or solidified and expanded the modified surface extends along a portion of the barrier length and the internal surface of the downhole tubing or formation along the rest of the length of the barrier has a radial cross section which does not vary longitudinally.

In embodiments, the method comprises filling a region of the wellbore such that once the barrier material has solidified or solidified and expanded the modified surface extends along the whole of the height of the barrier.

In embodiments, the modified surface comprises a helical groove running along the length of at least a portion of the internal surface of the downhole tubing or formation. A single continuous groove is formed in and spirals around the surface.

In embodiments, the internal surface is the internal surface of a section of electrically conductive tubing and modifying the shape of the internal surface comprises corroding selected portions of the internal surface using the downhole tool.

In embodiments, the method comprises establishing an electrical connection between the internal surface of the electrically conductive tubing and at least one conductive element such that the selected portions of the internal surface are corroded via an electrolytic process.

In embodiments, the at least one conductive element is coupled to an electrical power source and the tool comprises at least one expandable rail configured to move the conductive element or elements closer to the tubing. The rail may be configured to move the conductive element or elements in a direction perpendicular to the longitudinal axis of the tubing. This way the corrosion can be performed more efficiently by optimizing the distance between the internal surface and the cathode, reducing the amount of electrolyte present in the region between the cathode and the surface, and thus reducing power consumption. If a number of conductive elements are used, these may together form a shape that is substantially cylindrical or frustoconical. The overall cylindrical or frustoconical shape may include additional radial or helical grooves on its surface. The diameter of the cylinder or cone can be adapted by moving the electroconductive elements towards and away from the longitudinal axis of the tool by any means, but preferably using the rails described above. When a larger diameter is desired, there may be gaps between electroconductive elements. These can be avoided by including overlapping conductive elements or providing flexible conductive netting or webbing between the elements.

In embodiments, the surfaces of the at least one conductive element includes one or more zones which are covered with non-conductive material. This provides an alternative or an additional means by which the surface adjacent the conductive elements can be shaped. The shape of the modified surface can be controlled to an extent by moving the non-conductive portion in some embodiments.

In embodiments, the at least one conductive element is configured to rotate. Again, this provides mean by which the shape of the modified surface can be better controlled.

The invention provides a marked improvement in the sealing performance of downhole barriers and their capacity to remain in position. The invention was originally intended for use with plugging material that is metal or bismuth based, however the methods described herein can also improve the performance of other barrier material such as thermosetting, thermoplastic, or elastomeric polymers and composites, gels, ceramics, or cement-based barrier materials. Any material which solidifies either when cooling or otherwise, or which is able to conform to some extent to the shape of the modified internal surface of the tubing, casing, or formation can be used as the plugging or barrier material.

Modification of the internal surface of the metal tubing or of the formation where the barrier will be placed means that the surface against which the barrier will sit once installed includes additional anchoring features to prevent the barrier from shifting position, particularly in a longitudinal direction. This modification of the internal surface can be achieved by adding or removing material from the tubing or formation, however due to the simplicity of the operation it is preferred to remove material to form the anchoring features.

Downhole pressure below the barrier increases the contact forces between the barrier and the casing/tubing or formation. This can help to further increase the sealing properties of the barrier if a modified surface is used, since the barrier material is forced upwards against the anchoring points provided as grooves or indents to the surface.

Furthermore, with higher pressure rating capacity and the increased capabilities for the barrier to remain in position, the method also provides the user with the option of decreasing the length of the barrier while obtaining similar or better performance than for longer barriers formed using traditional methods. The deployment of shorter barriers helps to reduce cost and complexity of the operation.

The anchoring method described herein allows for a bismuth alloy barrier to be deployed and set at a reduced expansion rate while providing the same or improved sealing capacity as a bismuth alloy barrier set at a higher expansion rate, but without the risk of damage to surrounding components. Furthermore, the method described herein allows for the radial forces caused by the expansion of the bismuth-based barrier to be distributed both axially and radially. This helps to reduce the negative effects that the deployment of bismuth-based barrier has on the integrity of the surrounding tubing, particularly in the case of metal or metal-based tubing.

As the barriers usually are deployed in liquid phase, the liquid barrier material will take the shape of the container in which the barrier material is deployed. Where modification of the surface against which the barrier material is placed has been carried out by removal or addition of material to parts or all of the surface, the barrier material will conform to the modified shape of the surface. The barrier can then be shaped to have a larger diameter or radial cross section in some sections than in others. These wider portions which sit against narrower portions of the modified surface above and/or below preventing the barrier from shifting position. In other words, once the material solidifies the barrier will be anchored in the section or sections where the barrier's outside diameter is bigger than that of the unmodified container if material is removed from the surface during modification.

Material from the container can be removed or added to achieve an optimal shape for the modified surface which will improve the performance of the interface between the barrier and the container. The adaptions to the surface of the tubing or formation will increase the sealing capacity of the barrier by increasing the contact surface area between said barrier and the container and anchoring resulting from the regions of larger and smaller diameter in both the barrier and the surface against which it sits will be further improved by upward forces caused by the higher downhole pressure. As set out above, these improved sealing capabilities will result in a smaller or shorter barrier being required in order to achieve the required pressure ratings.

The modified surface will also improve the distribution of forces between the barrier and the container (particularly if the optimal shape is used), compensating for the removal of container material and therefore protecting the container from deformations or braking. The amount of material to be removed and the optimum shape of the internal surface of the container (which will comprise the tubing/casing or formation in most cases) will depend on many aspects such as the type of barrier material to be deployed, downhole pressures, the strength of the container and whether there is supporting material behind the metal tubing or not. In general, minimising the amount of material which needs to be removed from (or added to) the surface, whilst including enough anchoring points to provide good protection against shifting position of the barrier is desired.

The method can be used with any type of barrier material that is deployed in liquid phase such as metal or bismuth-based materials, thermosetting, thermoplastic or elastomeric polymers and composites, gels, ceramics or cement-based materials or any material which can conform to the modified surface during the filling stage. Generally, the barrier material should solidify either over time or due to cooling to plug the well.

The container can be modified by many methods such as cutting, milling, grinning, erosion or corrosion. These methods can be performed with wireline, coil tubing or drill pipe, among other means.

Embodiments of the present invention will now be described, by way of example only, with reference to the following diagrams wherein.

Figure 1:
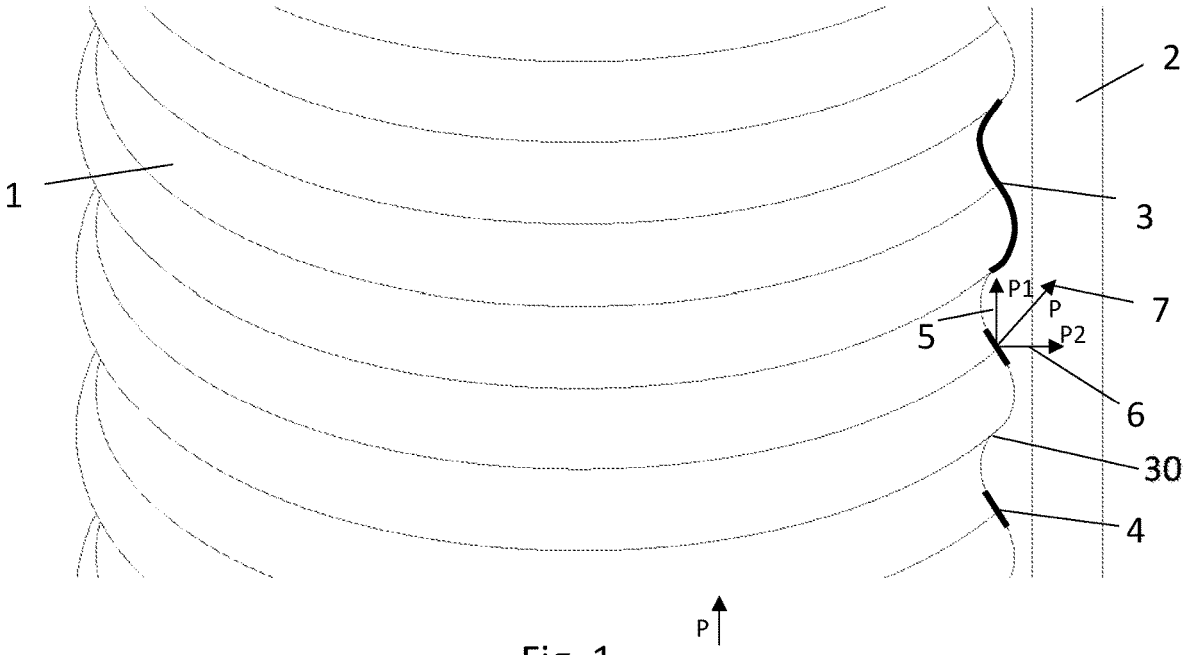
FIG. 1 shows an improved barrier shaped with a sinusoidal pattern.

The method described herein improves the sealing capabilities and stability of barriers in contact with a downhole surface. Barriers are anchored to help to prevent shifting position of the barrier once installed. This is achieved by the modification of the downhole surface to produce anchoring points for the barrier material. Generally, the surface against which the barrier will sit once set will be the surface of metal well tubing or casing or the internal surface of the wellbore itself (the formation surface). The formation or the tubing forms a container which is open at one end and into which barrier material can be melted, poured, or placed. A plug may be placed into the well before inserting the barrier material to control the level of the barrier within the wellbore. The formation surface or the internal surface 30 of a tube or casing 2 is shown in FIG. 1. In this case the surface is shaped to form areas of larger and smaller diameter. For a cross section of the surface taken in a longitudinal direction, the grooves in the internal surface form sinusoidal surface features 3.

An interface 3, which in the embodiment shown in FIG. 1 has a sinusoidal shape in a longitudinal cross-section, is formed between the barrier 1 and the internal surface 30 of the container 2. The barrier is held in position due to the presence of wider regions which sit against wider regions of the internal surface located above and below. The contact surface area between the barrier and the internal surface is increased by the modification to the surface, which improves sealing. Sealing may be improved by the expansion of the barrier if a material such as bismuth, which expands on cooling, is used. Radial forces due to any expansion of or pressure from the barrier material are distributed both axially 5 and radially 6 instead of only radial forces bearing on the internal surface, which may cause damage to casing. Forces originating from the well pressure below the barrier are also distributed both axially 5 and radially 6 instead of only axially. These forces increase the sealing capacity of the barrier 1 by increasing the pressure in the interface 3 between the mating and interlocking surfaces of the barrier 1 and the tubing or formation (internal surface 30). Increasing the sealing capacity in this way means that a smaller barrier may be required in order to support similar pressures compared to larger barriers where surfaces are unmodified.

Figures 2, 3, 4:
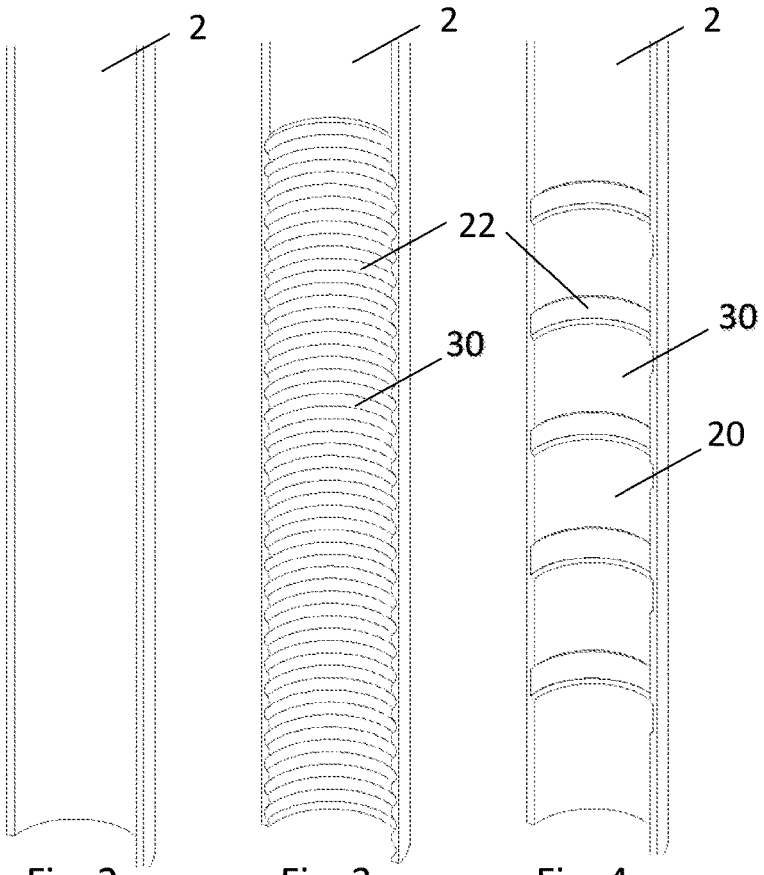
FIG. 2 shows an unmodified internal surface.
FIG. 3 shows a modified container with sinusoidal slots.
FIG. 4 shows a modified container with a modified internal surface comprising concentric slots separated by areas where material has not been removed.
Figure 5:
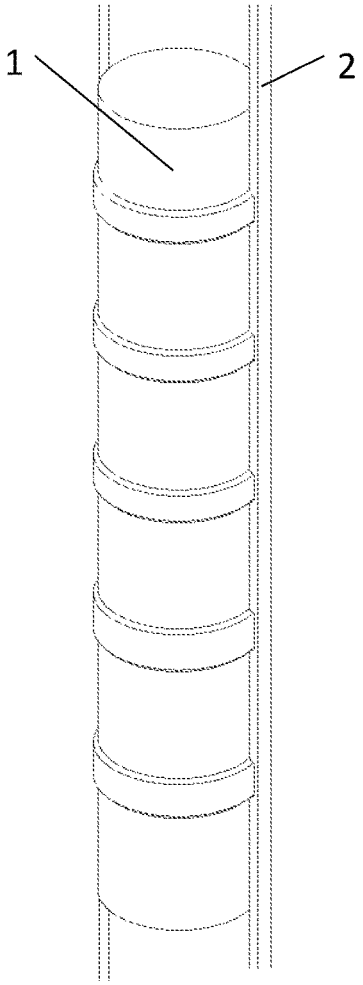
FIGS. 5 to 7 show examples of different modified internal surfaces and corresponding barriers.
Figure 6:
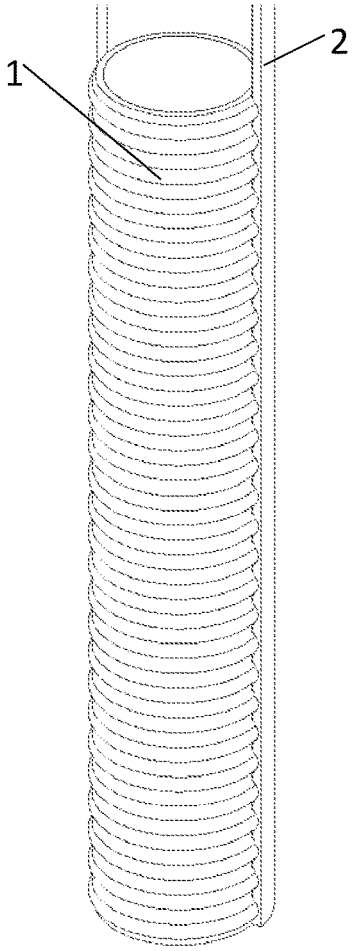
Figure 7:
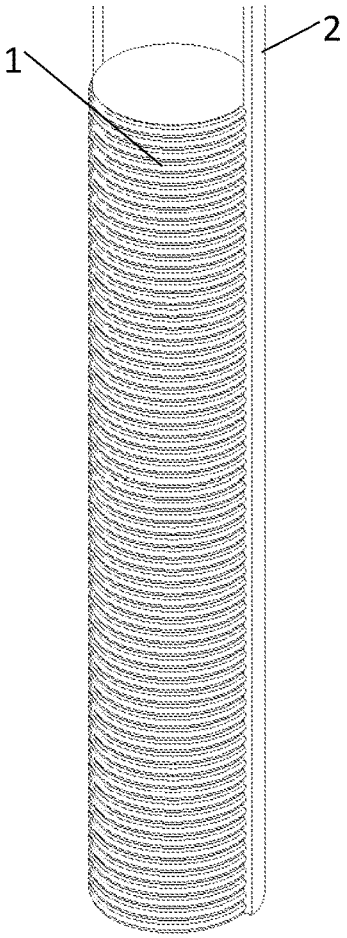
Figure 8:
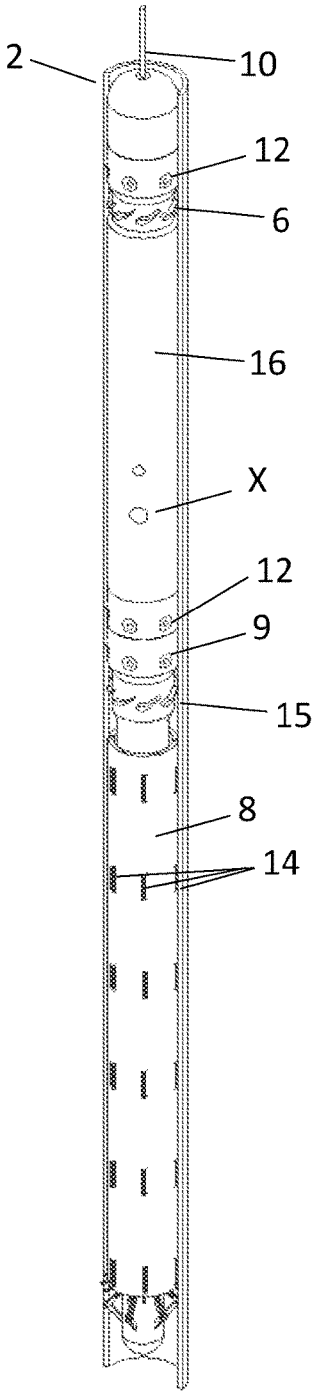
FIGS. 8 to 11 show examples of the preferred downhole tool to remove material from metal tubing.
Figure 9:
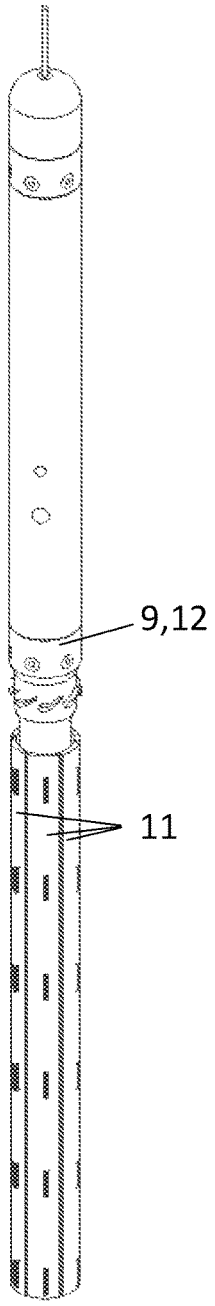
Figure 10:
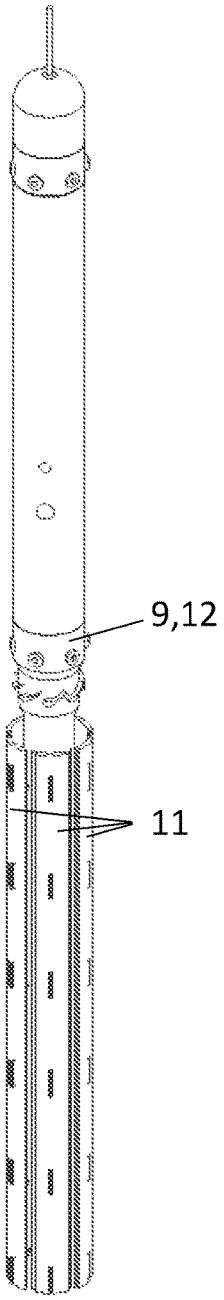

FIG. 2 shows an unmodified container comprising a section of tubing 2. In FIGS. 3 and 4 material has been removed from or added to parts of the inner surface of the tubing to form annular grooves 22. The spacing between grooves and the depth and width of the grooves can be varied as shown in FIGS. 5 to 7. Grooves may have a sinusoidal profile as shown in FIG. 1, or other profile type as shown in FIG. 4, among many. In general, a smooth profile is preferable (avoiding sharp edges). The grooves may be spaced close together (FIG. 3) which may improve the anchoring properties of the surface or further apart (FIG. 4) which may reduce any potential weakening of the surface structure while still helping to anchor the barrier.

When installing a barrier 1, such as the barrier shown in FIGS. 1 and 5 to 7, the barrier will initially be in its liquid form. The liquid barrier will fill the voids or grooves 22 left by modification of the surface. Once the liquid barrier has solidified, the barrier 1 will have a shape which corresponds to (is the inverse of) and interlocks with or mates with the shape of the internal surface 30 as shown in FIGS. 5 to 7.

The integrity of a structure forming the internal surface 30 (such as metal tubing or casing 2) might be weakened when material is removed. Therefore, the amount of material to be removed and the remaining surface shape of the structure must be optimized in order to increase the barrier 1 performance while minimizing the effect on the integrity of the metal tubing 2. There are several ways in which to achieve this optimization.

Figure 13:
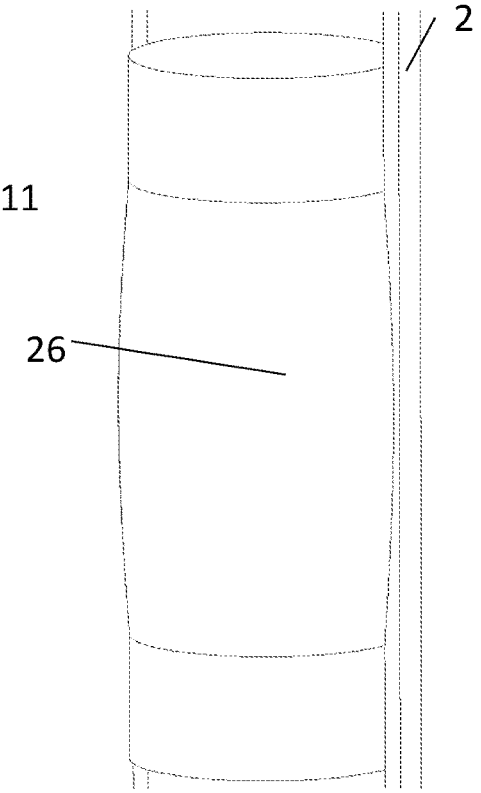
FIG. 13 shows a barrier formed in as a long half cycle sinusoid.
Figure 14:
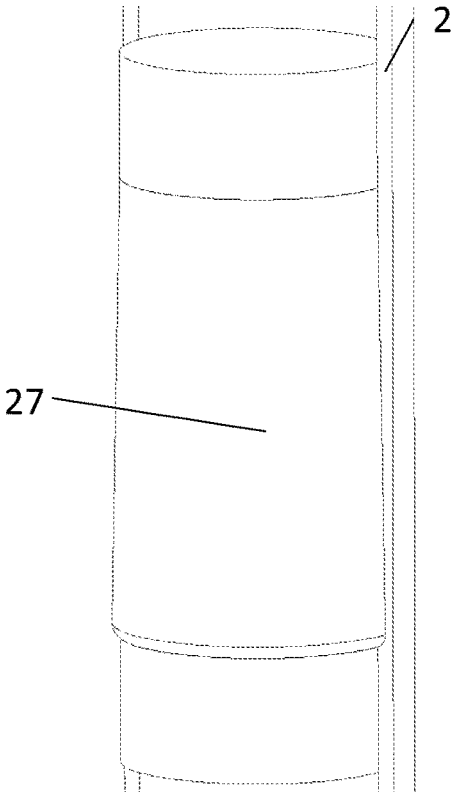
FIG. 14 shows a frustoconical shaped barrier.
Figure 15:
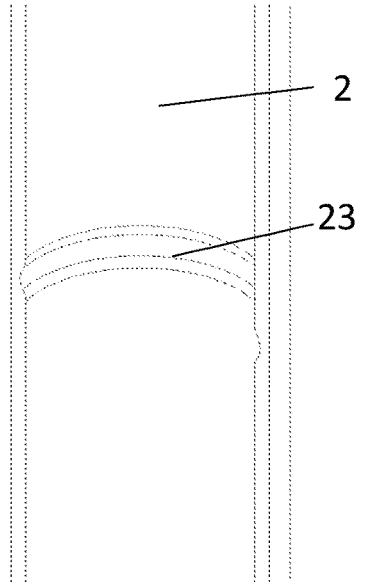
FIG. 15 shows the container with one sinusoidal anchoring slot.

Increasing the number of grooves for a grooved structure will increase the number of seals as wells as anchoring places, however it will also remove more material from the structure forming the internal surface 30. A choice of how many anchoring points to include and how closely spaced these should be will depend on the material used to form the barrier, as well as the material of the internal surface itself. The surface may be shaped with one anchoring point 23, 26, or 27 as shown in FIGS. 13 to 15, or may contain a plurality of anchoring points as shown in at least FIGS. 4, 5, 6, and 7. Anchoring points formed by the modified surface may extend along the whole length of the barrier as shown in at least FIGS. 3, 6, and 7.

The shape of the surface, and in particular of the longitudinal variation in width of the tubing or formation, may also be optimized. Possible configurations of the longitudinal cross sectional shape of the grooves are triangular, square, metric, ACME, buttress or a combination of the above. Grooves may extend in a helical path around the internal surface or may extend as a plurality of annular grooves as described above. One of the preferred shapes for the grooves is the sinusoidal shape, as it provides good debris tolerance and reduces the stress on the container 2. It is also one of the easiest shapes to form using downhole electrolytic cells to remove material, which is a convenient method for modifying the internal surface and which will be described in more detail below. The sinusoidal anchor cluster is shown in FIG. 1.

Figure 12:
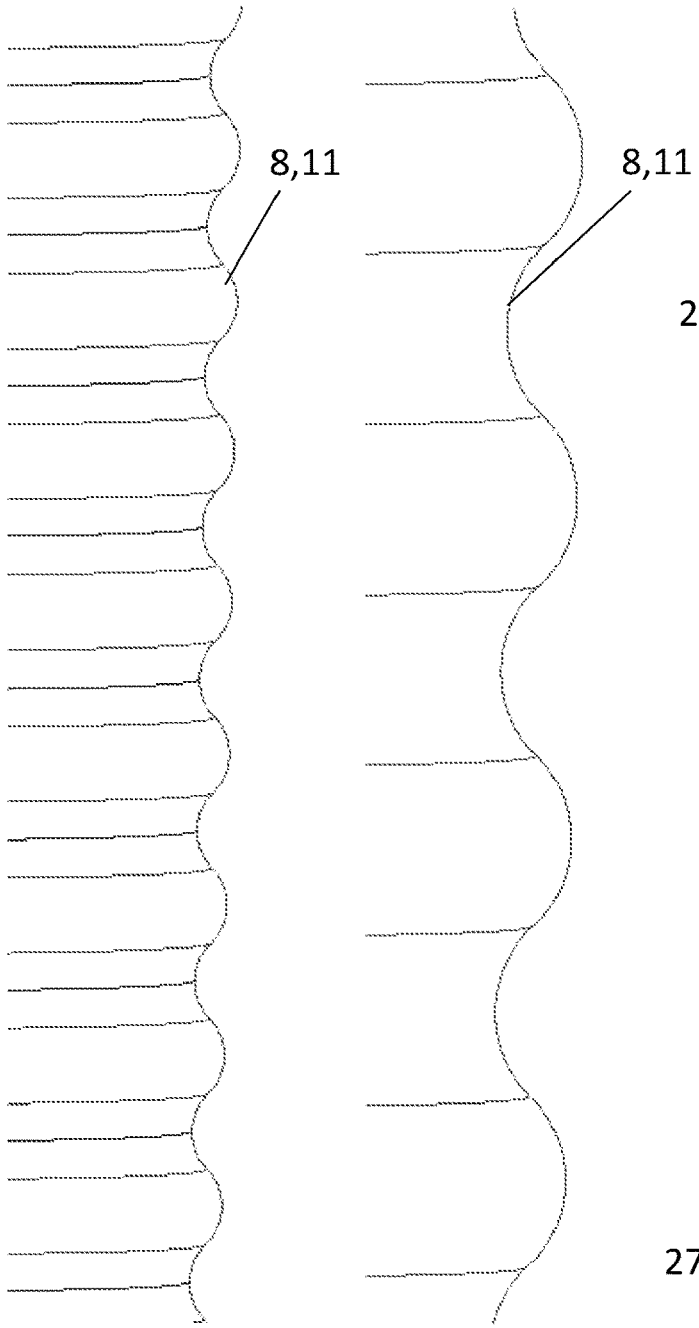
FIG. 12 shows sinusoidal shaped cathodes with different frequencies and amplitudes.

The optimal amplitude and frequency of the sinusoidal shape is dependent on the size of the metal tubing, properties of the barrier material and downhole pressures to mention a few variables. The surface 30 may therefore be shaped with high frequency and high amplitude sinusoidal longitudinal cross section, with a low frequency and low amplitude sinusoidal longitudinal cross section, or a combination thereof. The sinusoidal shape of the surface 30 may have a high frequency and low amplitude as shown in FIG. 12 (left side) or a higher amplitude and lower frequency sinusoidal shape as shown in FIG. 12 (right side). The amplitude may be formed in an example by removing between 0.1 to 90%, preferably between 0.1% and 60%, and most preferably between 0.1% and 10%, of the wall thickness of the metal tubing 2 over the length of one quarter sinusoid. The frequency may be for example between one quarter sinusoid over the entire anchoring point, or the entire length of the modified surface, to 10 entire sinusoids over 1 centimeter of longitudinal cross section. In an example, as shown in FIG. 13, the surface 30 of container 2 is shaped so that the barrier includes an anchor point shaped as a half sinusoid 26 (low frequency).

An alternative preferred shape is shown in FIG. 14. This frustoconical shaped barrier 27 has larger outside diameter in the downhole end as compared to the upper end. This allows for the downhole pressure applied to the barrier to be evenly distributed over a wide surface area, increasing the sealing capacity of the barrier while preserving the integrity of the container, formation, or tubing. Any combination of the different shapes for the modified surface can be applied. As specific examples of combinations which may be applied, the frustoconical shape or the half sinusoid shown in FIGS. 13 and 14 can include one or more additional radial or helical grooves on their surfaces of the types described above. Alternatively, the modified surface may include a length modified to include grooves and an adjacent length modified as in FIG. 13 or 14.

The anchoring points may be ring shaped, however they may also be in the form of a helix extending around the surface 30, If the grooves cut into the surface are ring shaped or helical then they will extend all of the way around the cylindrical surface. In some embodiments, however, grooves may extend only part of the way around the surface in a radial direction.

Figure 16:
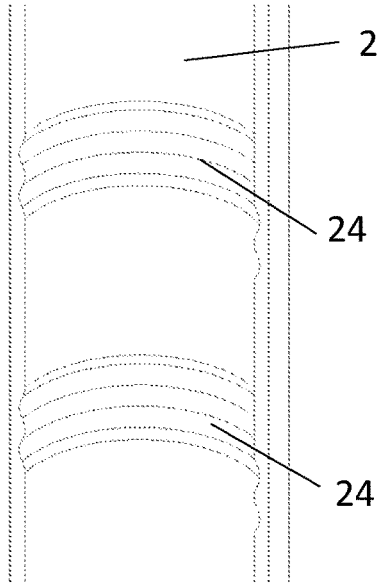
FIG. 16 shows the container with 2 clusters of anchoring slots.

Anchoring points, here in the form of grooves, may also be separated into clusters 24 spaced along the length of the barrier. As an example, while FIG. 15 shows a surface modification in the form of a single groove 23 cut into the internal surface 30 of downhole tubing 2, FIG. 16 shows two clusters 24 each comprising two sinusoidal grooves in two different positions along the surface 30. Between the two clusters no material is removed or added from or to the surface. Each cluster 24 increases the sealing capacity of the barrier but the spaced configuration helps to reduce the amount of material removed from the surface 30. The number of clusters, and the shapes of anchoring points or grooves within each cluster, the positions of the clusters as well as the distance between the clusters can vary as necessary in order to optimize the barrier performance.

Figure 17:
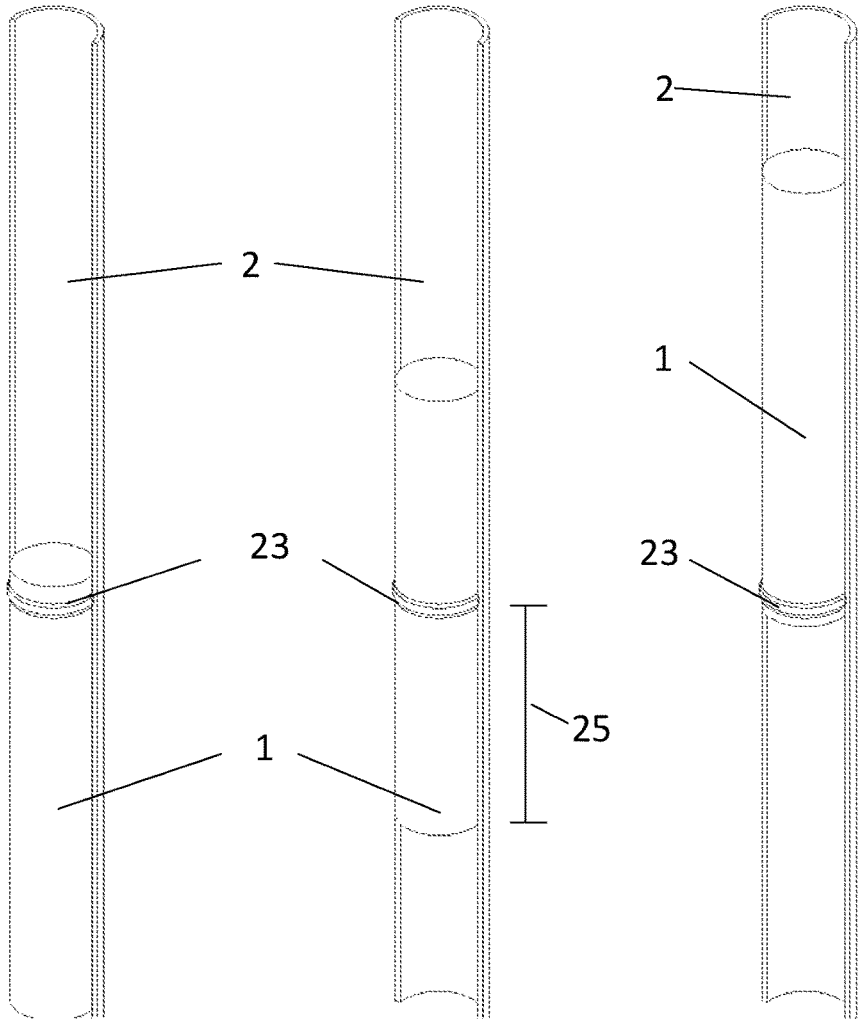
FIG. 17 shows different position of the anchoring places relative to the barrier.
Figure 18:
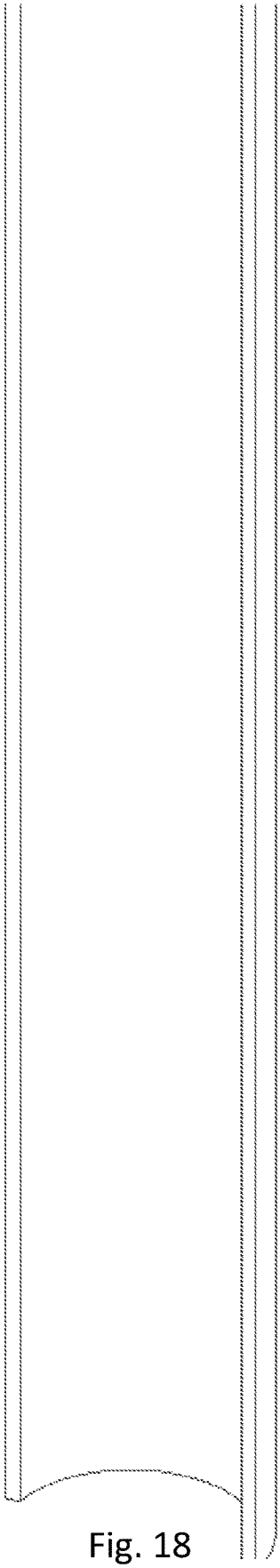
FIG. 18 shows an unmodified internal surface.
Figure 19:
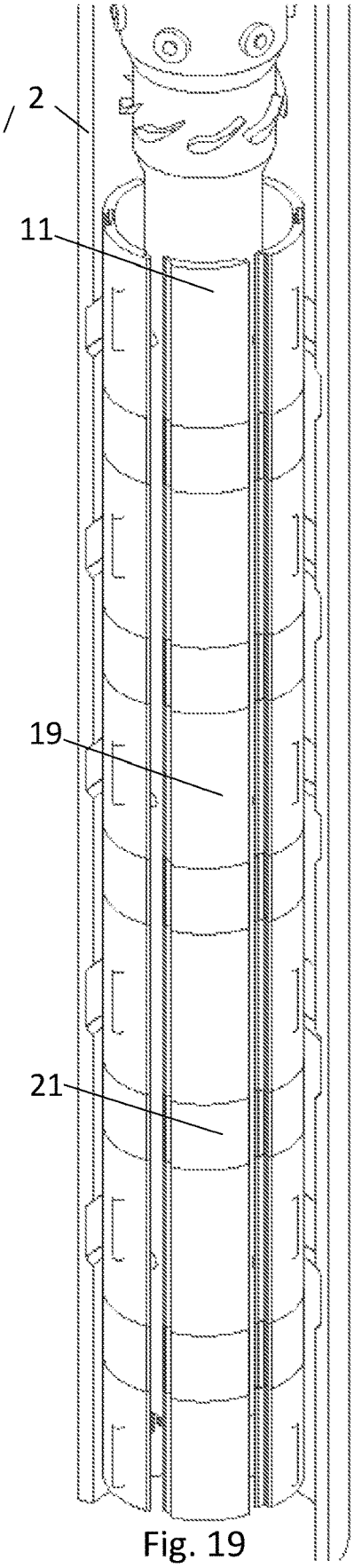
FIG. 19 shows one of the preferred downhole tools to remove material from the metal tubing.

Downhole pressures applied axially (from below) to an anchored barrier may cause the barrier to balloon below the anchoring point. The axial force may deform the barrier radially, increasing the radial forces between the barrier and the container and therefore the sealing capacity of the barrier. The radial deformation of the barrier is dependent on the properties of the barrier material and the length of barrier below the anchoring point. An anchoring point is shown as point 23 on barrier 1 which sits within casing or tube 2 in FIG. 17. The region of the barrier 25 below the anchoring point may be caused to contract axially and expand radially by pressure from below. The position of the anchoring point can therefore be adjusted to provide a high sealing capacity while reducing the risk of damaging the casing due to the radial forces caused by the barrier ballooning effect. The single anchoring point or anchoring clusters may be placed at the top, bottom, or between the top and bottom of the barrier, as shown in FIG. 17. As mentioned, some material below the anchoring point is preferable to provide a tighter seal due to pressure forces, however this should be balanced with the possibility of damage to the tubing if the barrier expands too far.

There are a number of means by which to modify the internal surface of a formation or downhole tubing in order to obtain the benefits described above. A downhole tool may be used that is configured to mill, ream, drill, grind, erode or cut material. Such tools can be deployed using wireline, coil tubing or drill pipe and may include commercially available reamers, underreamers and wireline or coiltubing operated cutting tools to mention a few alternatives.

If the surface modification is to be performed in metal tubing, or any electrically conductive surface, the preferred method for modifying the surface is to remove portions of the casing material using a downhole tool comprising an electrolytic cell to accelerate the corrosion of the metal tubing. An example of such a tool is shown in FIGS. 8 to 10, 11, and 19.

The downhole tool may comprise at least one conductive element 8 arranged to corrode selected portions of the surrounding tubing 2 using an electrolytic process, said conductive element 8 being made of electric conductive material, an apparatus 9 to establish a connection to the metal tubing 2, and a source of electrical power.

In order to operate said downhole tool, the brine contained in the well may be conditioned to be of the preferred conductivity. This brine creates a conductive path which allows the electrical current to flow between the conductive element 8 and the conductive tubing 2.

In order to modify the internal surface of the tubing, the downhole tool is lowered into the well as a conventional wireline or coil tubing tool. It is positioned at the desired depth and clamps 12 and connector 9 for coupling the downhole tool to the metal tubing are activated.

Figure 11:
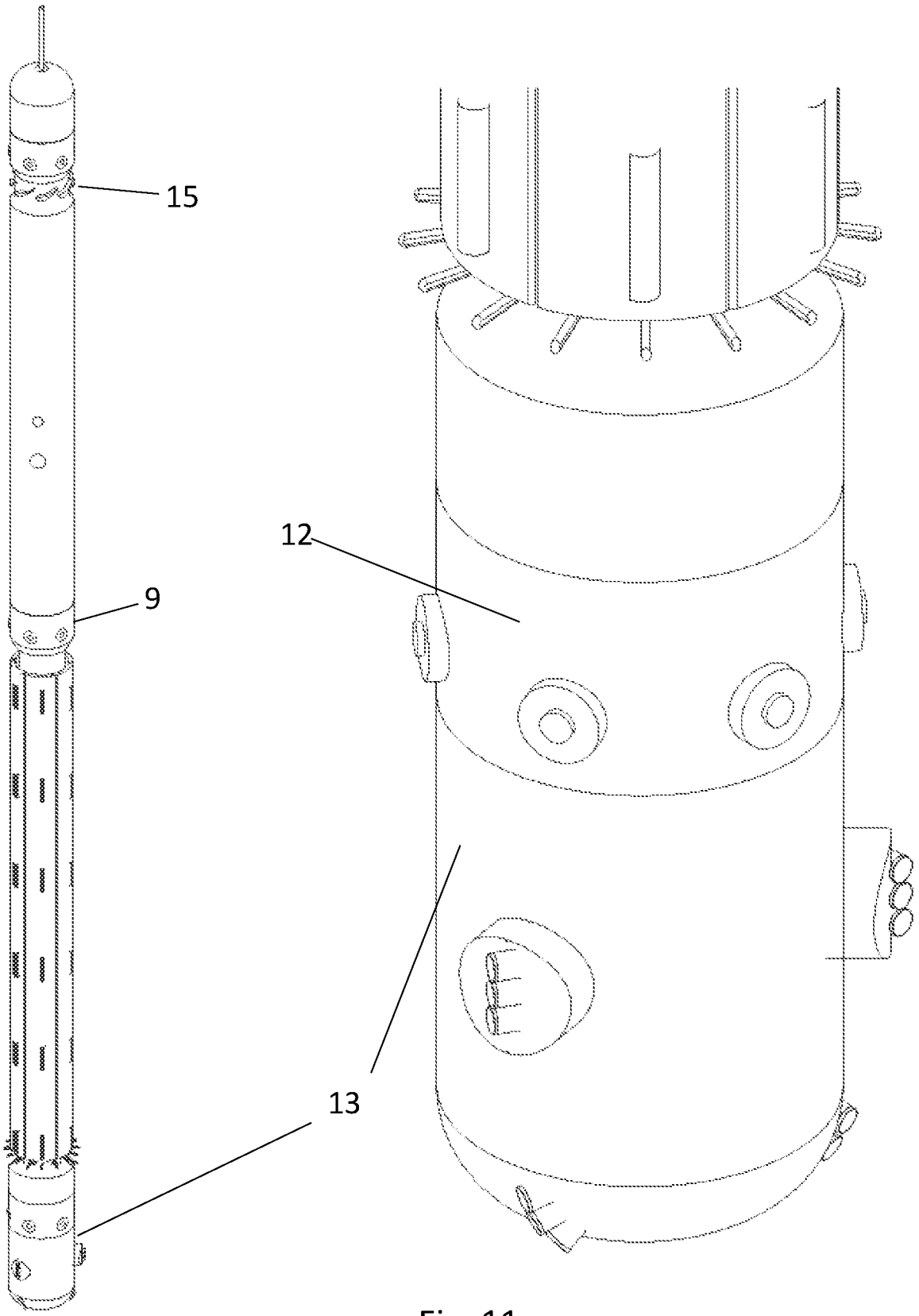

If the downhole tool is fitted with a milling apparatus 13 as shown in FIG. 11, said apparatus can be used to clean scale or other material depositions from the surface of the casing.

The conductive elements 8,11 are then provided with electrical current either by a downhole power unit 16 or directly from the surface through the wire 10. Accelerated corrosion of the metal tubing will then begin.

The brine contained in the well may be circulated around the conductive element 8,11 and the metal tubing 2 in order to avoid the formation of by-products which could reduce the efficiency or the electrolytic process. Circulation may be achieved using an apparatus 15 (shown in FIG. 11).

Expandable rails may be used in order to set the one or more conductive elements at the desired distance from the tubing. The distance is, however, limited by the presence of non-conductive spacers 14 in order to avoid shorting. Once set at the optimal distance, the electrical current will be provided.

The conductive elements may be configured to rotate and/or to move in an axial direction within the borehole. Rotation may be continuous or intermittent (may rotate for a period of time in a direction, stop rotating for a period, and then start again in the opposite direction, and so on). If the downhole tool is fitted with rotating conductive elements 11 then the continuous or periodic rotation may be used in order to even out the corrosion of the internal surface of the metal tubing. Spacers 14 can also be used to remove any by-product from the metal tubing 2 or aid the circulation of the electrolyte surrounding the conductive elements 11.

The shape of the conductive elements can be configurable or can be set in order to form particular shapes. Conductive elements may be shaped to achieve the desired surface modification. A possible shape for the conductive elements is shown in FIG. 12, and this will result in an internal surface of the tubing shaped as shown in FIG. 1. Where the conductive element is wider, material will be corroded from the internal surface faster, so that the shape of the modified surface will mirror that of the conductive element. The downhole tool can also be fitted with one or more elements together forming a frustoconical shape in order to shape the internal surface of the tubing as shown in FIG. 14, where more material has been removed adjacent the bottom end of the conductive element 8,11 than adjacent the top end.

The variation in distance between the conductive elements 8,11 and the metal tubing 2 will force more electrical current to be diverted towards the zones where this distance is shorter. Higher current will result in more material being removed and therefore the shape of the conductive element 8,11 would be mirrored in the metal tubing internal surface.

Figure 20:
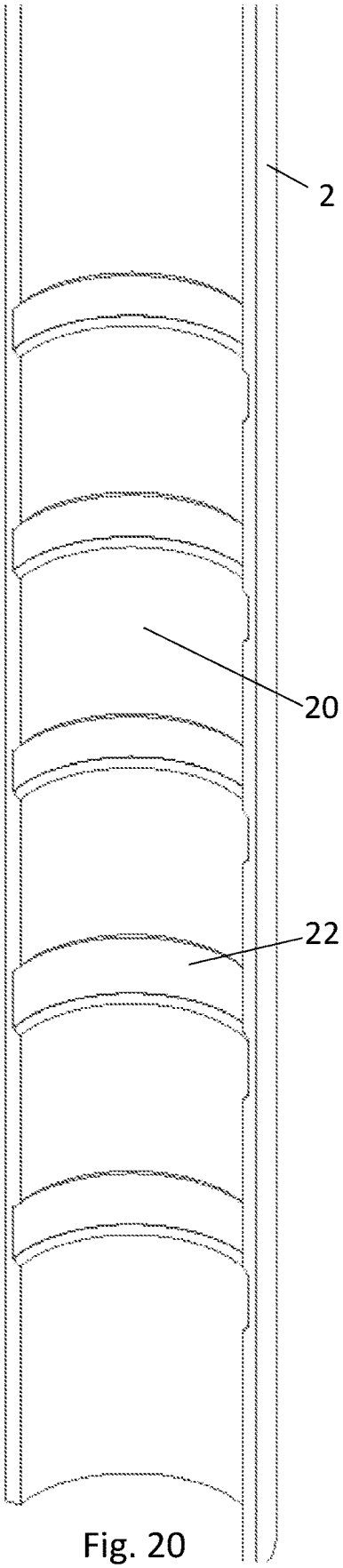
FIG. 20 shows a modified internal surface.

An alternative method, which can be used to create the grooves shown in FIGS. 4 and 20, is to cover areas of the conductive elements with non-conductive material in order to isolate zones 20 where material from the metal tubing 2 does not need to be removed. The uncovered portions of the conductive elements will allow the current to remove material from the metal tubing 2 in regions 22 of the internal surface 30 that are located adjacent to these portions.

The amount of material removed from the surface is proportional to the electrical current provided. The amount of material to be removed can be calculated and controlled by a measurement of the current applied between the conductive elements and the tubing over time. Once the desired amount of material is removed and the desired surface configuration has been achieved, the electrolytic process is stopped. The shaped surface 30 of the metal tubing 2 is cleaned using the rotating conductive elements 8,11 and the spacers 14 or by any other method. The downhole tool is then pulled out of the hole so that the barrier material can be inserted.

In order to install the barrier, a plug may need to be placed downhole of the modified surface in order to prevent the barrier material from travelling further down into the borehole. Once the plug is inserted, the barrier material is placed above the level of the plug. This may be achieved by pouring the material into the borehole or by melting the material once already inserted into the borehole. The barrier material fills the area adjacent to the shaped surface such that it conforms with the surface and is left to solidify at which point a barrier is formed. The barrier will be anchored to the shaped or modified surface wherever an indent is formed in the surface as described above.

The invention claimed is:

1. A method for inserting a barrier in a wellbore having a section of tubing therewithin, wherein the section of tubing has an internal surface, an internal diameter, an external surface and an external diameter, the method comprising:

modifying a shape of the internal surface of the section of tubing within the wellbore, thereby providing a modified internal surface of the section of tubing, such that the internal diameter of the section of tubing varies in a direction parallel to the central axis of the section of tubing while a shape of the external surface of the section of tubing and the external diameter of the section of tubing remain unmodified; and filling a region adjacent the modified internal surface of the section of tubing with barrier material and allowing the barrier material to solidify to interlock with and be anchored by the modified internal surface.

2. The method of claim 1, wherein modifying the shape of the internal surface of the section of tubing within the wellbore comprises including a pattern of indents therein.

3. The method of claim 2, wherein modifying the shape of the internal surface of the section of tubing within the well bore comprises providing a region of the internal surface of the section of tubing having a radial cross section which varies longitudinally, such that the barrier material is configured to be anchored longitudinally.

4. The method of claim 1, wherein the barrier material is a liquid during the filling.

5. The method of claim 1, wherein modifying the shape of the internal surface of the section of tubing within the well bore comprises providing a region of the internal surface of the section of tubing having a radial cross section which varies longitudinally, such that the barrier material is configured to be anchored longitudinally.

6. The method of claim 1, further comprising modifying the shape of an internal surface of the section of tubing within the wellbore by removing material from the section of downhole tubing using a downhole tool.

7. The method of claim 6, wherein removing the material from the section of tubing using the downhole tool comprises removing between 0.1% and 90% of the material from the section of tubing.

8. The method of claim 7, wherein forming the modified surface comprises removing between 0.1% and 60% of the material in a length of the tubing.

9. The method of claim 8, wherein forming the modified surface comprises removing between 0.1% and 10% of the material in a length of the tubing.

10. The method of claim 6, wherein the section of tubing is electrically conductive and wherein modifying the shape of the internal surface of the section of tubing within the wellbore comprises establishing an electrical connection between the tubing and at least one conductive element such that selected portions of the internal surface of the section of tubing are corroded via an electrolytic process.

11. The method of claim 10, wherein a surface of the at least one conductive element is shaped with one of, patterns or grooves to control the shape of the internal surface of the section of tubing.

12. The method of claim 10, wherein the at least one conductive element is centrally placed in a downhole tool.

13. The method of claim 1, wherein modifying the shape of the internal surface of the section of tubing within the wellbore comprises adding material to the section of tubing using a downhole tool.

14. The method of claim 1, wherein modifying the shape of the internal surface of the section of tubing within the wellbore comprises forming a plurality of radial grooves in the internal surface of the section of tubing within the wellbore.

15. The method of claim 14, wherein a profile of the plurality of radial grooves is sinusoidal in a longitudinal cross section through the internal surface of the section of tubing.

16. The method of claim 1, wherein modifying the shape of the internal surface of the section of tubing within the wellbore comprises modifying the shape of the internal surface of the section of tubing within the wellbore such that the internal diameter is a larger diameter at a lower end of the section of tubing and a smaller diameter at an upper end of the section of tubing.

17. The method of claim 1, wherein modifying the shape of the internal surface of the section of tubing within the wellbore comprises removing between 0.1% and 90% of the material in a length of from the section of tubing.

18. The method of claim 17, wherein forming the modified surface comprises removing between 0.1% and 60% of the material in a length of the tubing.

19. The method of claim 18, wherein forming the modified surface comprises removing between 0.1% and 10% of the material in a length of the tubing.

* * * * *